US007527165B2

(12) United States Patent
DiDato

(10) Patent No.: US 7,527,165 B2
(45) Date of Patent: May 5, 2009

(54) DISPOSABLE BEVERAGE CONTAINER WITH LID

(75) Inventor: Richard C. DiDato, Amawalk, NY (US)

(73) Assignee: Brain Box Concepts, Inc., Amawalk, NY (US)

( * ) Notice: Subject to any disclaimer, the term of this patent is extended or adjusted under 35 U.S.C. 154(b) by 42 days.

(21) Appl. No.: 11/447,404

(22) Filed: Jun. 5, 2006

(65) Prior Publication Data

US 2006/0283867 A1 Dec. 21, 2006

Related U.S. Application Data

(60) Provisional application No. 60/687,831, filed on Jun. 6, 2005.

(51) Int. Cl.
*A47G 19/22* (2006.01)
*B65D 47/06* (2006.01)

(52) U.S. Cl. ..... 220/714; 220/203.19

(58) Field of Classification Search ..... 220/714, 220/715, 713, 711, 203.2, 203.19, 828, 827, 220/603, 373; 222/463; 292/344; 215/21, 215/22, 23

See application file for complete search history.

(56) References Cited

U.S. PATENT DOCUMENTS

| | | | | |
|---|---|---|---|---|
| 241,183 | A | 5/1881 | Bauman | |
| 1,045,993 | A | 12/1912 | Lucas | |
| 1,328,104 | A * | 1/1920 | Servis | 222/91 |
| 1,454,803 | A * | 5/1923 | Wells | 222/500 |
| 1,743,605 | A * | 1/1930 | Hollender | 222/196.2 |
| 2,007,049 | A * | 7/1935 | Hellmann | 222/450 |
| 2,021,683 | A * | 11/1935 | Clark | 220/324 |
| 2,191,066 | A * | 2/1940 | Barber | 266/171 |
| 2,324,999 | A * | 7/1943 | Shinn | 220/202 |
| 2,385,594 | A * | 9/1945 | Witte, Jr. | 126/384.1 |
| 2,419,769 | A * | 4/1947 | Frank | 222/500 |
| 2,433,142 | A * | 12/1947 | Moen | 220/348 |
| 2,605,024 | A * | 7/1952 | Clark | 222/190 |
| 2,675,815 | A * | 4/1954 | Dale | 137/43 |
| 3,067,908 | A * | 12/1962 | Graham | 220/203.2 |
| 3,355,207 | A * | 11/1967 | Newman | 292/78 |
| 3,389,423 | A * | 6/1968 | Johnson | 16/75 |
| 3,470,885 | A | 10/1969 | Lebel | |
| 3,952,910 | A | 4/1976 | Wheeler | |
| 4,394,928 | A | 7/1983 | Philip | |
| 4,579,245 | A | 4/1986 | Narushko | |
| 5,186,353 | A | 2/1993 | Ramsey | |
| 5,772,061 | A | 6/1998 | Lowe | |
| 5,772,067 | A * | 6/1998 | Morewitz, II | 220/714 |
| 5,971,203 | A * | 10/1999 | Bae | 220/746 |

(Continued)

FOREIGN PATENT DOCUMENTS

WO WO 9637742 A1 * 11/1996

*Primary Examiner*—Anthony D Stashick
*Assistant Examiner*—Robert J Hicks
(74) *Attorney, Agent, or Firm*—Gottlieb Rackman & Reisman PC

(57) ABSTRACT

A container for beverages and the like is provided with a lid having a spout through which the beverage can be dispensed and a seal with a closed position in which the seal blocks the spout and an open position in which the spout is open. An actuator is provided that automatically moves the seal between the open and closed positions as the beverage is tilted.

22 Claims, 8 Drawing Sheets

U.S. PATENT DOCUMENTS 6,012,617 A * 1/2000 Knight et al. ..... 222/481.5
6,062,419 A 5/2000 Kruger et al.
6,302,307 B1 * 10/2001 Hirsch et al. ..... 222/500
6,470,924 B2 * 10/2002 Chen ..... 141/65
6,780,366 B2 * 8/2004 Vang et al. ..... 264/301
6,824,003 B1 11/2004 Wong
7,093,738 B1 * 8/2006 Evans et al. ..... 222/205
2001/0032849 A1 * 10/2001 Martin, Jr. ..... 220/203.19

* cited by examiner

DISPOSABLE BEVERAGE CONTAINER WITH LID

RELATED APPLICATIONS

This application claims priority to provisional application Ser. No. 60/687,831 filed Jun. 6, 2005, incorporated herein by reference.

BACKGROUND OF THE INVENTION a. Field of Invention

This invention pertains to an improved drinking container with a lid and more particularly, to a container having a lid with an opening that is automatically closed unless the container is tilted to a drinking position.

b. Description of the Prior Art

In our busy society, many people prefer to take out various food items in disposable containers, and then consume the food items at their leisure. For example, customers frequently prefer buying beverages, such as tea, coffee, etc. in a disposable cup.

In order to insure that the contents of the cup are not spilled easily, the cup is covered with a snap-on lid. The customer can then drink from the cup by removing the lid. However, removing and replacing the lid is very inconvenient, especially if a person is walking, driving, etc. In fact, if the container is relatively soft, it is overfilled, or is thin and contains a hot liquid, it is virtually impossible to open and close the container without spilling some of its contents.

One common solution to this problem is to provide the lid with a spout. For example, it is common to provide the lid with score lines or other means that define tabs or other opening elements in the lid which may be removed to form a spout. The container is then closed so that its contents do not normally spill. The customer can remove the tab and then drink directly through the spout. Some lids are also formed with a round opening covered with a break-away tab. A customer can insert a straw to break off the tab and drink through the opening. However, straws are not very convenient for dispensing hot liquids.

A problem that occurs with all lids with spouts or other openings is that, once the opening is made in the lid, the contents of the cup can be spilled easily whenever the cup is shaken or turned sideways in any manner.

Therefore there is a need for a disposable cup with a lid and an opening with a means of reclosing the opening. Preferably, the closing means should open and close automatically, when required. The lid can but does not have to be disposable.

SUMMARY OF THE INVENTION

Briefly, a container for dispensing beverages and the like includes a lid having a spout and mechanism for selectively and automatically opening and closing the spout in response to the tilting of the container. The mechanism includes a seal movable between an open position in which the seal does not interfere with liquid flow through said spout and a closed position in which said seal closes said spout. An actuator is associated with the lid and it pivots about an axle as the container is tilted. The actuator is arranged and constructed to move said seal between said open and closed positions. A rod extends from said actuator and said seal.

A locking mechanism is optionally provided that controls the movement of the seal and/or the actuator. The locking mechanism is operated by a user to override the operation of the actuator and keep the spout open or closed independently of the attitude or tilt of the container.

DETAILED DESCRIPTION OF THE INVENTION

Figure 1:
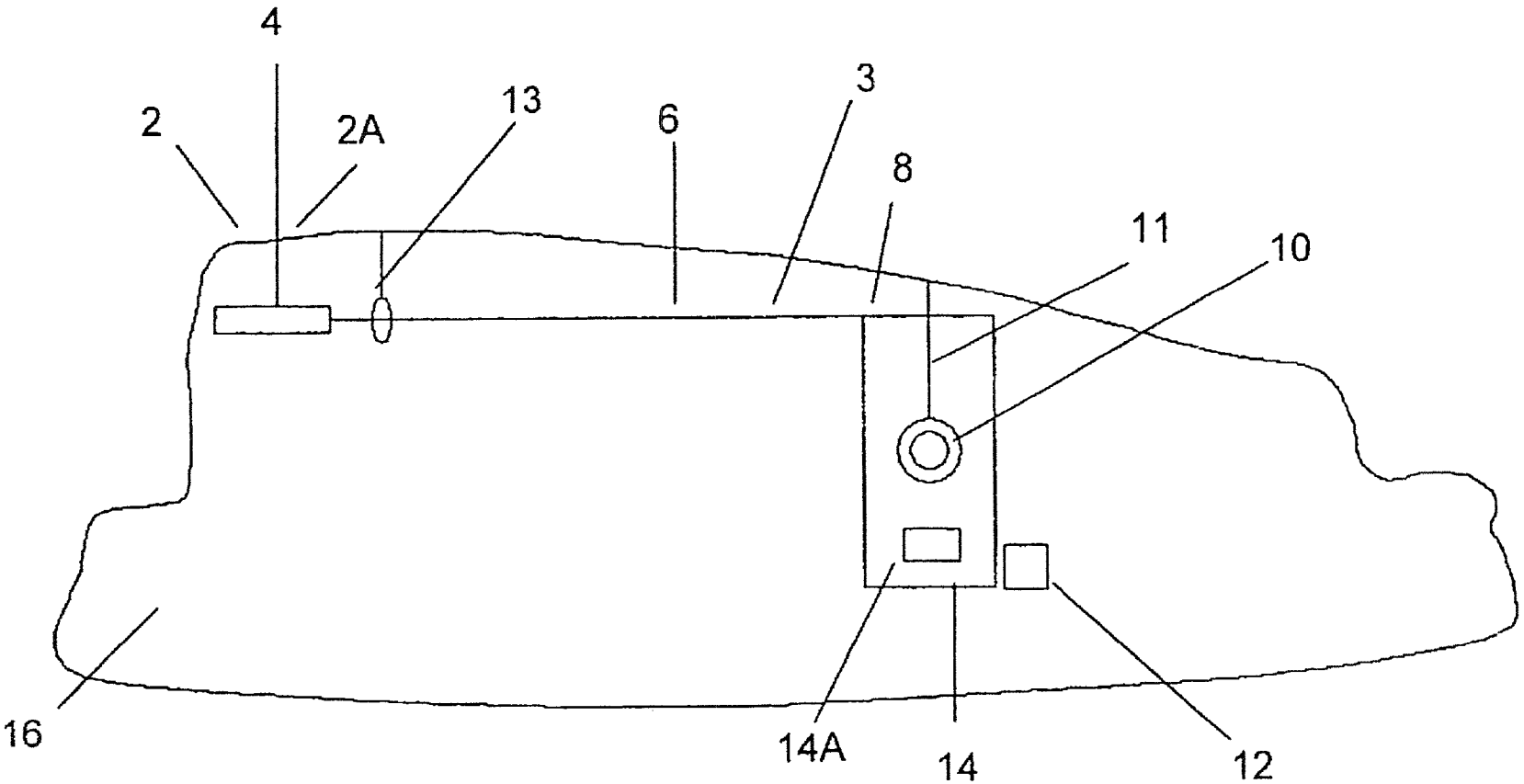
FIG. 1 shows a side sectional view of a container lid with a recloseable spout constructed in accordance with this invention.
Figure 2A:
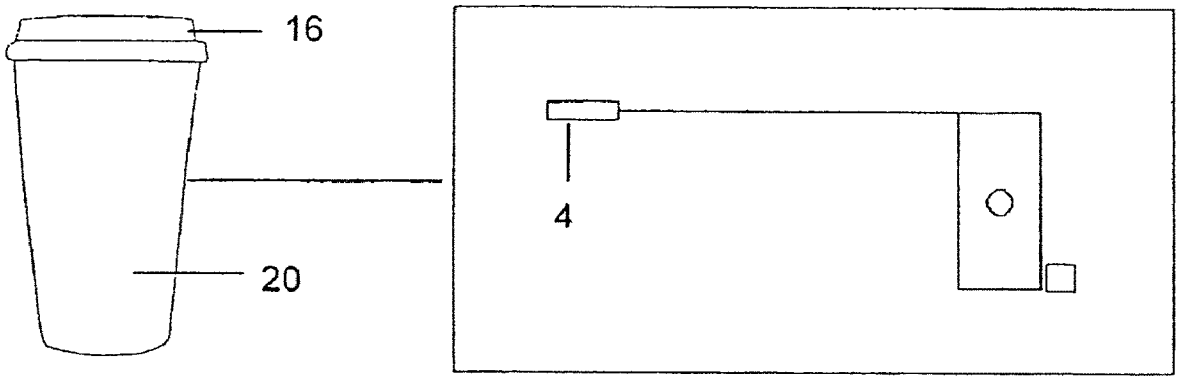
FIG. 2A shows a vertical cup and the elements of the lid in the closed position.
Figure 2B:
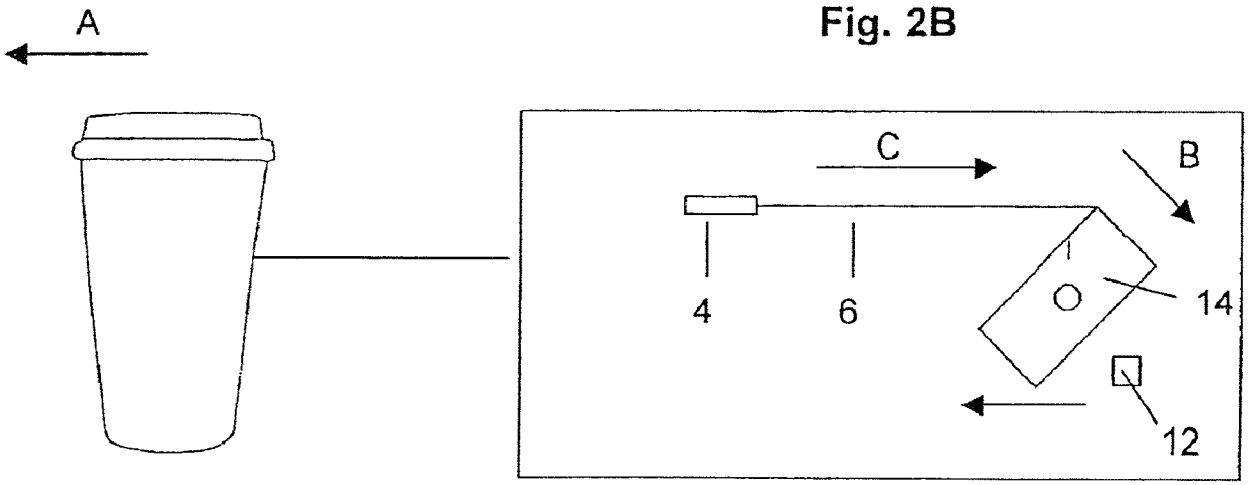
FIG. 2B shows the cup of FIG. 2A and its elements tilted to the open position.

A preferred embodiment of a beverage cup with an automatically recloseable lid is shown in FIGS. 1, 2A, 2B. The lid 16 is shaped and sized to close a cup 20. The lid and the cup normally have a generally circular cross-section, but may have other cross-sections as well. Moreover, generally, the lid 16 is either slightly oversized to fit over and snap onto a lip formed on the cup (not shown), or is slightly underside to fit telescopically into the cup and form an interference fit therewith. However, other means may be used to mount the lid on the cup 20. For example, both may be formed with threads, so that the lid can be twisted on and off. In some instances, the lid could be attached permanently to the cup as well. This structure is advantageous for some cases where the contents of the container are under pressure. In other instances, the lid and the container can be formed into a single unitary closed container.

As shown in FIG. 1, the lid 16 is formed with a hole or spout 2. The hole may be square, oval, rectangular, etc. Moreover, preferably, initially, the hole is closed by a removable section or tab 2A of the cup to insure that the cup is sealed until the customer wants to drink from the cup. The section 2A may be defined by a score line that allows the section 2A to be selectively broken away and separate from the lid 16 to create spout 2.

The lid 16 is provided with a mechanism 3 for automatically closing and opening the spout 2. Mechanism 3 includes a seal 4 that is sized and shaped to fit over the spout 2 preferably from the inside surface of the container. However, the mechanism 3 including seal 4 can also be disposed on the outside of the container 20, on top of lid 16. In FIG. 1 the seal 4 is shown being spaced from the hole for the sake of clarity, however, it should be understood that, preferably the seal 4 abuts the sides of the spout 2 to form an effective closure therefore.

The mechanism 3 further includes a pivoting actuator 14. The actuator 14 is rotatably mounted on a horizontal shaft 10. The shaft 10 is mounted by two support means 11 to lid 16. The actuator 14 is attached by a hinge 8 and an elongated lever 6 to the seal 4. The lever 6 may pass through a sleeve or other similar guide means 13 attached to lid 16 to guide and support the lever 6 and allow it to move essentially longitudinally as described in more detail below.

The hinge 8 may be a separate element, or the actuator 14, lever 6 and seal 4 may be molded as a single piece with the hinge 8 being a living hinge. The mechanism 3 may also include a stop 12 positioned to limit the rotation of the actuator in the clockwise direction. The stop is also supported by the lid 16 by support means that have been omitted for the sake of clarity.

The guide means 13 is supported from the lid 16 as shown.

The actuator 14 may be provided with a weight 14A at its bottom portion, below the rod 10 to insure that the center of gravity of the actuator is below the shaft 10. Alternatively, the actuator 14 may be formed or shaped to achieve the same result.

The various elements of mechanism 3 are preferably made of a plastic material or other light materials that are durable and inexpensive. Moreover, while the various elements of mechanism 3 are shown and described as discrete elements, it should be understood that all or some of the elements of the mechanism 3 may formed as a single unitary piece by molding, casting or other similar methods. As discussed above, the elements of the mechanism 3 are all supported, either directly, or indirectly, from lid 16.

Initially, as shown in FIG. 1 and FIG. 2A, the actuator 14 and lever 6 cooperate to position the seal 4 under the spout 2 so that the container 16 is closed. As shown in FIG. 2B, if the cup 20 is tipped forward, in the direction indicated by the arrow A, gravity causes the actuator 14 to rotate relative to the cup in the opposite direction indicated by the arrow B. As the actuator 14 rotates clockwise, it pulls lever 6 and seal 4 to the right, as indicated by arrow C, thereby uncovering the spout 2. This action enables the customer to drink from the container 20 through spout 2. When the customer is finished, he returns the cup to its previous position, causing the actuator 14 to pivot back to its original position. The actuator 14 then causes the seal 4 to return and cover spout 2 again.

If the cup 20 is tipped in any other direction, the actuator 14 remains in place and does not rotate in the direction opposite to B because of stop 12, thereby maintaining the spout 2 sealed.

Figure 3:
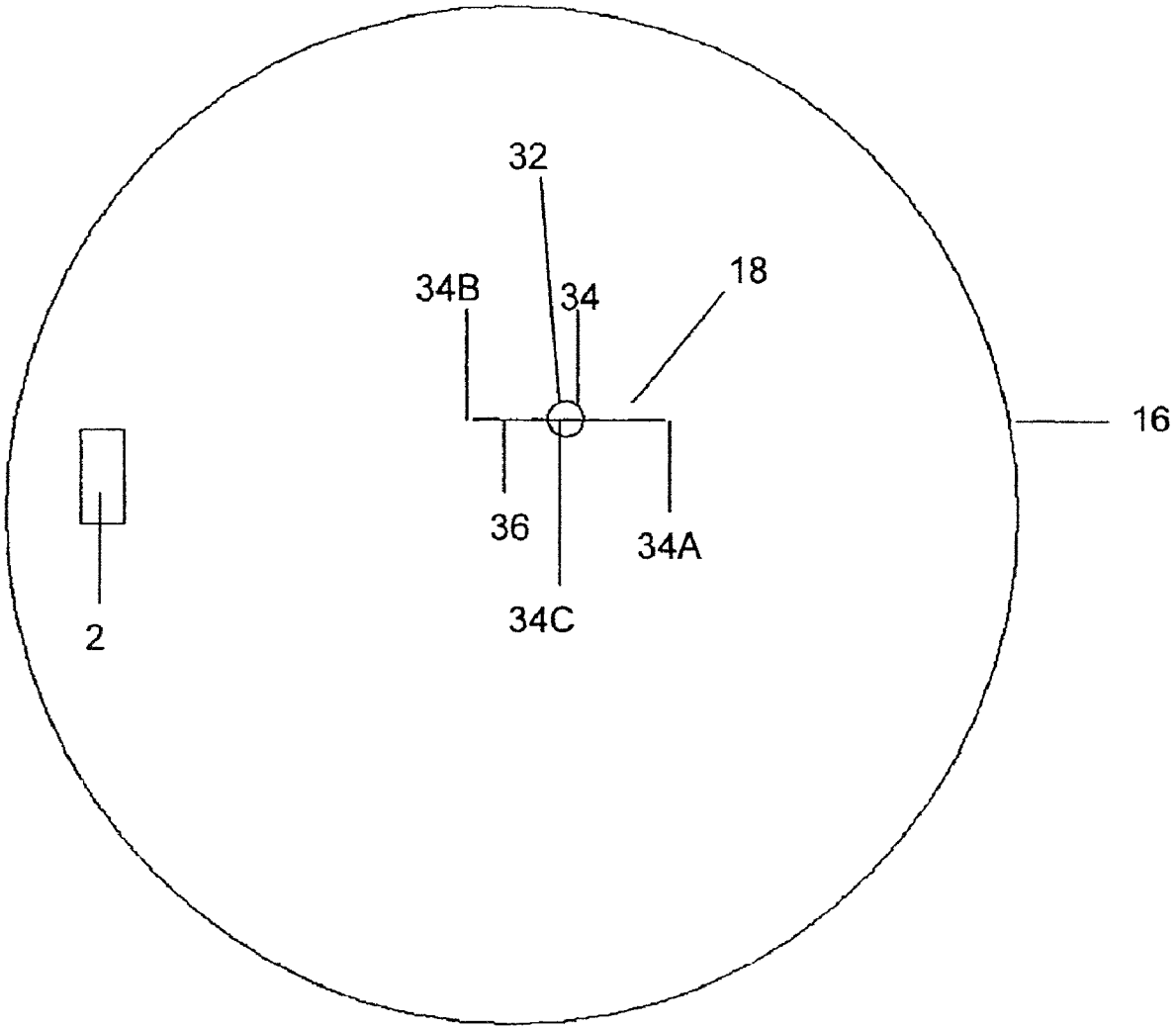
FIG. 3 shows a top view of the lid of FIG. 1.

In another embodiment of the invention, a locking member 18 is also provided for the cup 20. As shown in FIG. 3, this locking member 18 is mounted on the lid and includes a slider 34. The slider frictionally engages a track or cutout 36 in the lid 16. The slider 34 can be manually moved along the track between position 34A, the closed position, and position 34B, the open position. The slider 34 also has a center position 34C. In the center position, the slider 34 allows the mechanism 3 to operate in the manner described above.

Figure 4:
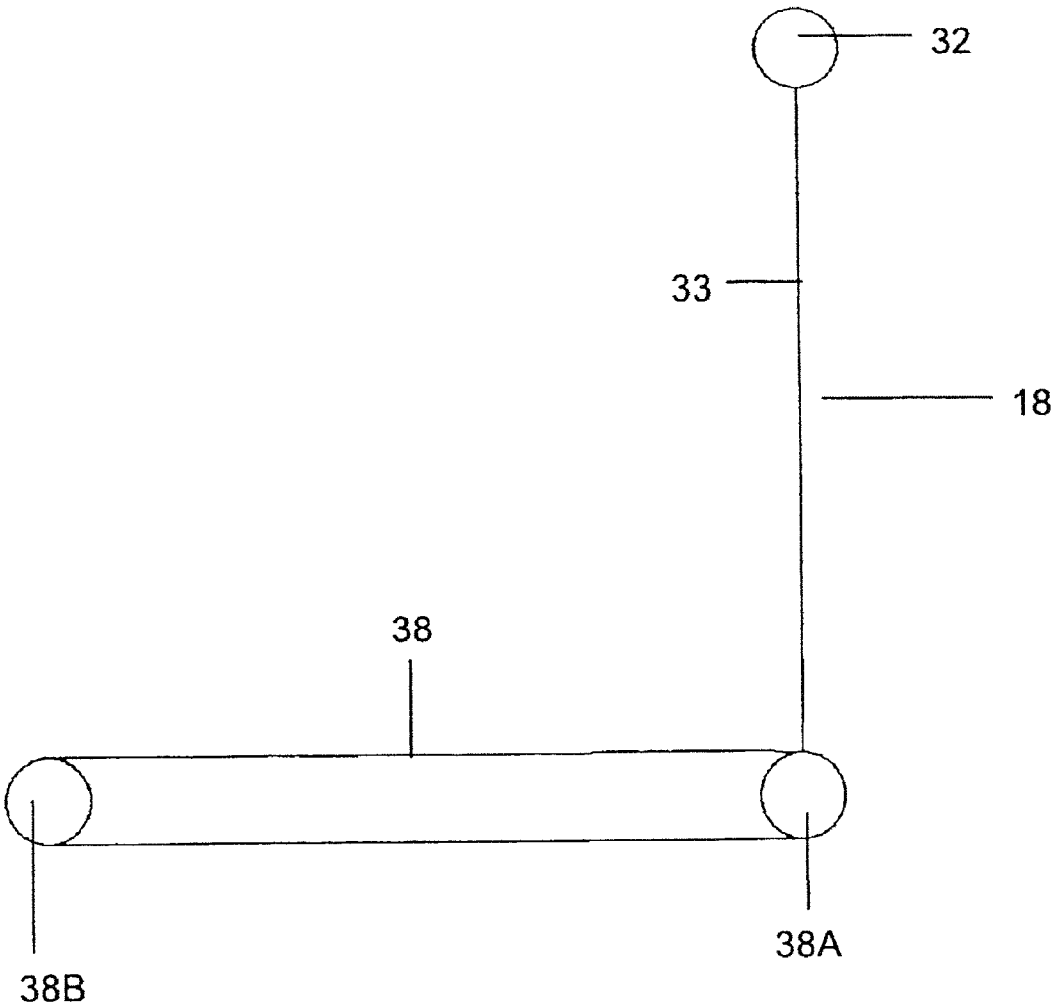
FIG. 4 shows a side view of the locking mechanism used for the lid constructed in accordance with this invention.
Figure 5A:
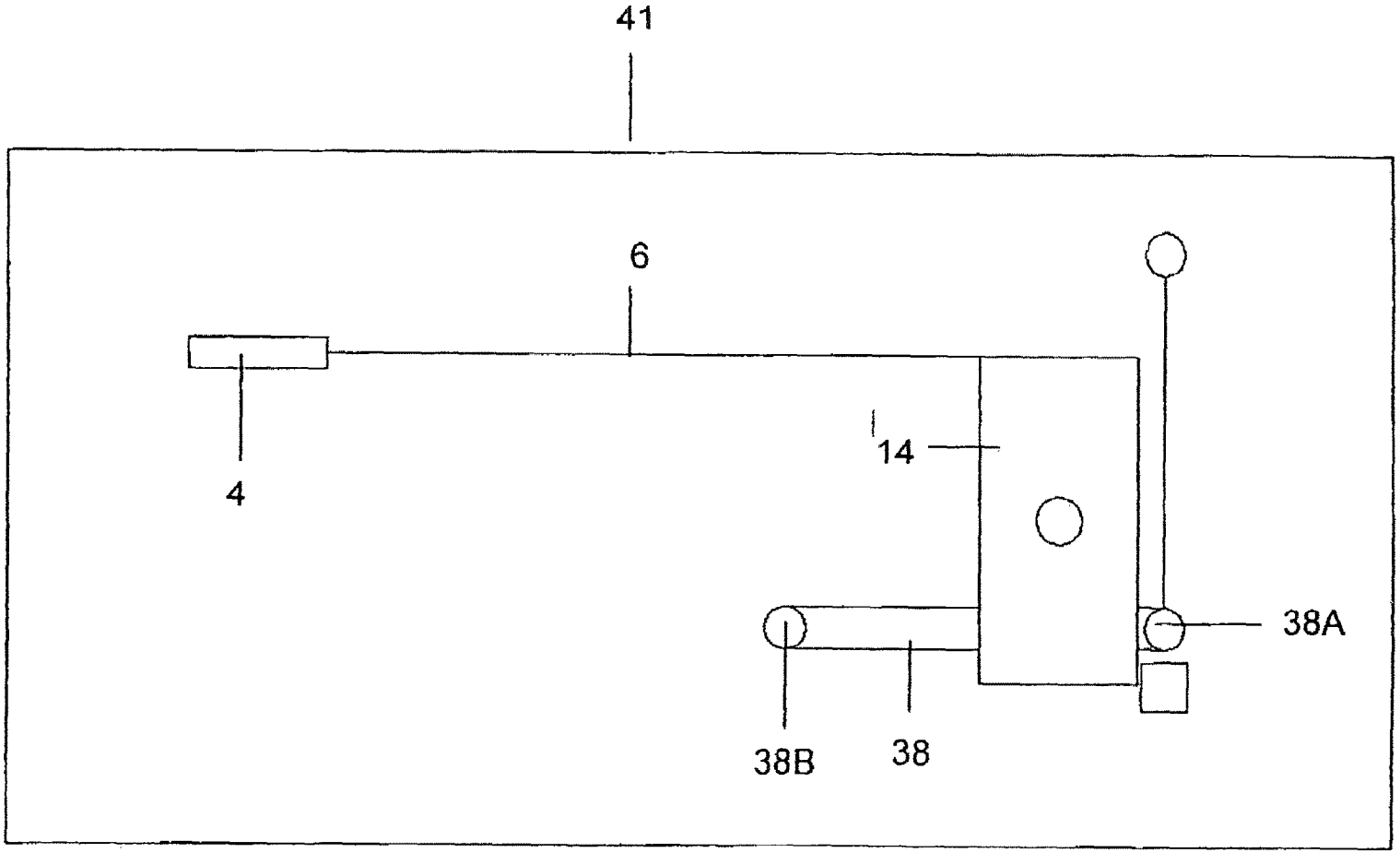
FIG. 5A shows a side view of the lid closing mechanism with the locking mechanism in the automatic position.
Figure 5B:
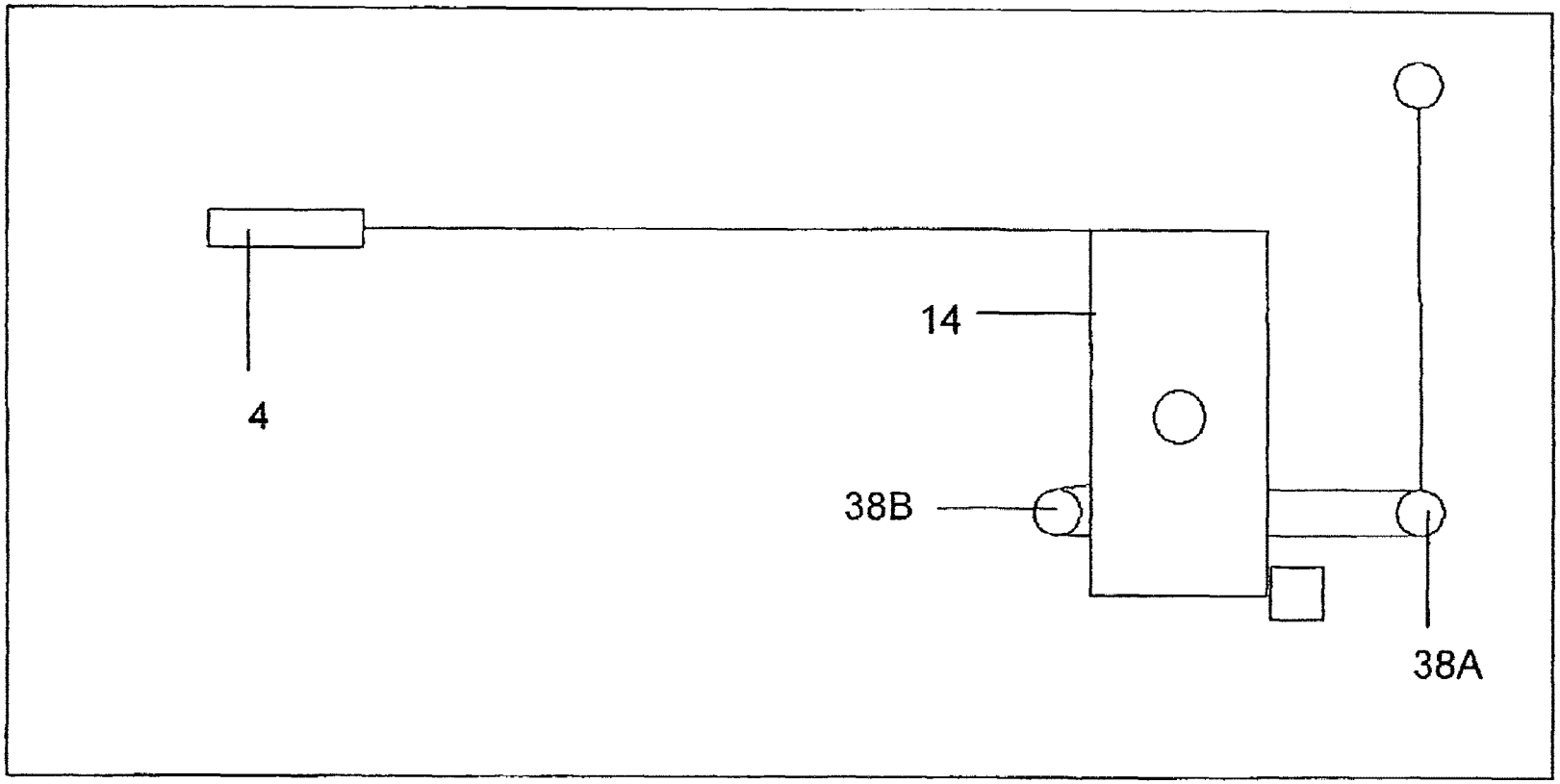
FIG. 5B shows a side view of the lid closing mechanism with the locking mechanism in the unlocked position.
Figure 5C:
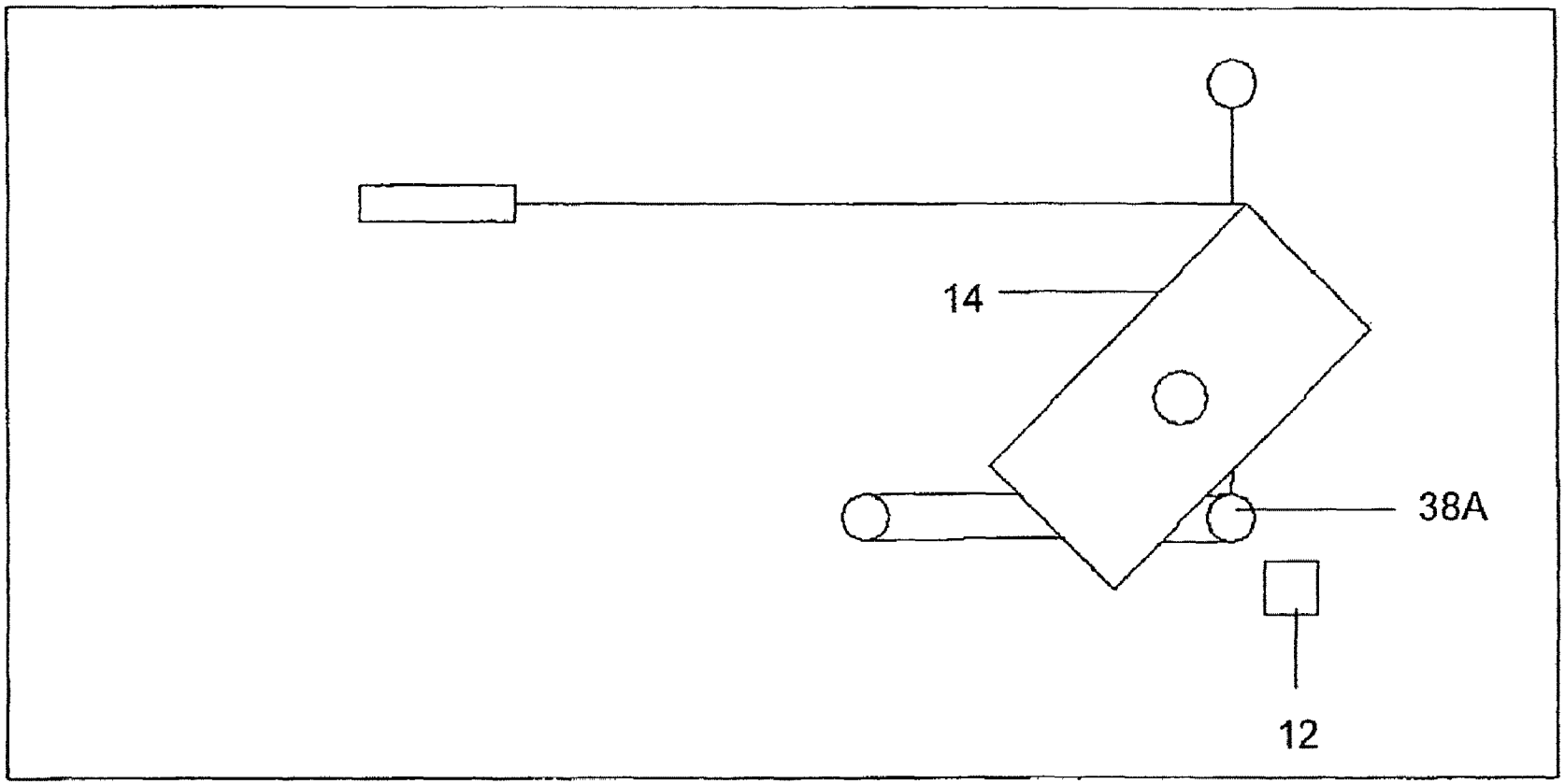
FIG. 5C shows a side view of the lid closing mechanism with the locking mechanism in the locked position and the closing mechanism in the open position.

Referring to FIGS. 4 and 5, slider 34 is terminating with a knob 32 on one end, and a U-shaped horizontal member 38 having two ends 38A, 38B. The knob is disposed above the lid 16 so that it can be operated by a user, while the member 38 is disposed below the lid 16 and connected to the knob 32 by a rod 33.

In the position of FIG. 5A, the member 38 is in a neutral position with its ends 38A, 38B placed so that they do not interfere with the movement of the actuator 14. When the slider 34 is pulled back, as shown in FIG. 5B, the end 38B of member 38 cooperates with stop 12 to trap the actuator 14 and prevent it from tipping, thereby insuring that the spout 2 remains closed, even if the cup is tipped.

If the slider 34 is pushed forward, end 38A engages and rotates the actuator 14 causing the seal 4 to pull back and uncover spout 2 independently of the position of the cup 20. Biasing means such as springs may be used to ease the movement of the slide and otherwise assist the operation of the closing mechanism 3 and/or locking mechanism 18.

Figure 6:
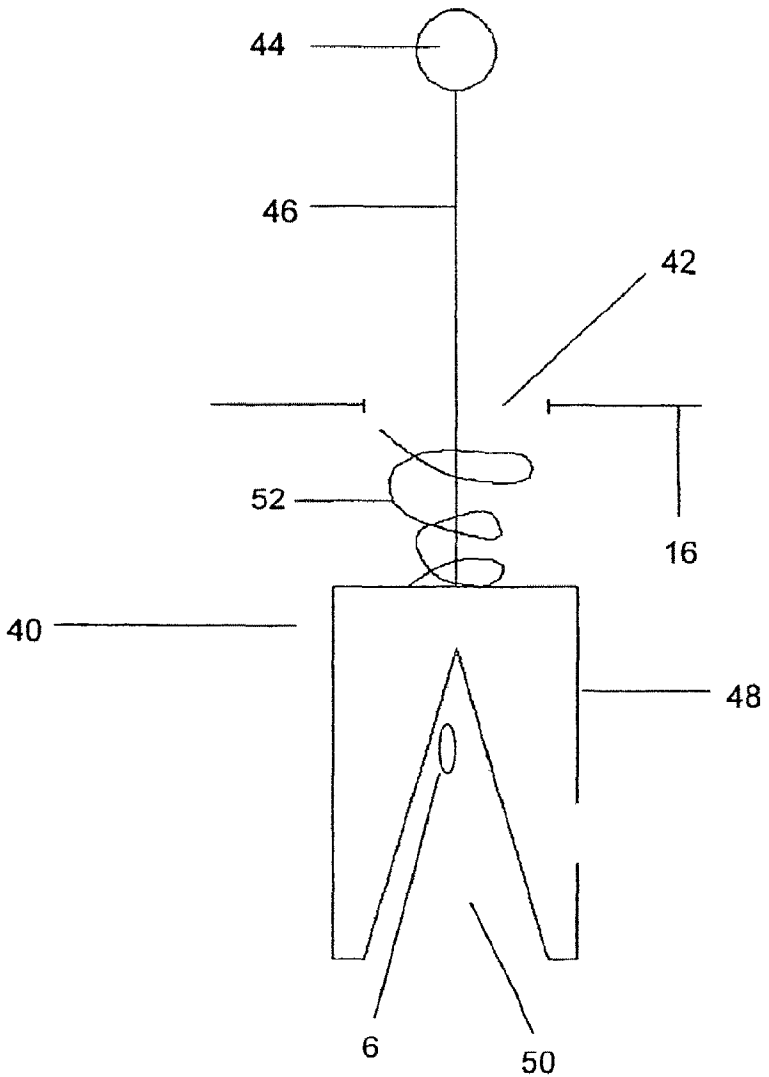
FIG. 6 shows in a side view details of an alternate locking mechanism.

In another embodiment of the invention shown in FIG. 6, a locking mechanism 40 is provided that extends through a hole 42 in cover 16. The mechanism includes a knob 44, a rod 46 extending downwardly of the knob 44 and a plate 48 with a V-shaped cutout 50. A spring 52 may be used to bias the mechanism 40 upward toward an unlocked position. The locking mechanism 40 is mounted on the lid 16 at an intermediate position along bar 6, as position 41 shown in FIG. 5A.

In the unlocked position, the lever 6 slides through and is guided by the V-shaped cut-out 50 so that there is substantially no interference with the movement of the lever 6. If the knob 44 is pushed down, an interference fit is created between the walls of the cut-out 50 and the rod 6 thereby substantially immobilizing the lever 6. Thereafter, the rod 6 does not move, independently of whether the cup is tipped. If the mechanism 40 is pushed down while the cup is held horizontal, the lever 6 is immobilized with the spout 2 closed. If the cup is tilted forward and then the mechanism 40 is pushed down, the lever 6 is immobilized with the spout 2 opened. The lever 6 is released by pulling the mechanism 40 up to disengage from the lever 6.

Obviously numerous modifications may be made to the cup described herein without departing from its scope as defined in the appended claims.

I claim:

1. A container having a body with a spout positioned to allow the contents of the container to be drunk when the container is tilted from its vertical position toward a drinking position by an angle of 0 to 90 degrees, the container comprising:

a seal positioned to selectively cover and uncover said spout; and a pivoting weight secured within said container and linked to said seal, said weight having a first position in which said seal covers said spout and second position in which said seal is remote from said spout, said weight moving from said first to said second position as said container is tilted, said weight further maintaining said seal in the first position when the container is tipped in directions other then said second position.

2. The container of claim 1 wherein said weight is remote from said spout further comprising a linkage between said weight and said seal.

3. The container of claim 1 further comprising a stop limiting the movement of said spout.

4. The container of claim 1 further comprising locking means for locking said weight in one of first position in which said spout is closed and a second position in which said spout is opened.

5. A lid for a beverage container comprising:

a body shaped and sized to fit over and close said container and having a periphery;

a spout formed in said body through which the container content can be selectively dispensed, said spout being disposed adjacent to said periphery to allow said container content to flow out when the container is tipped forward from a vertical orientation;

a seal attached to said lid and selectively movable between a closed position in which the spout is closed by said seal and an open position in which beverage can be dispensed from said container; and an actuator attached to said body, said actuator being pivoted by gravity about an actuator axis that is horizontal when said lid is disposed on a container oriented along its vertical axis and being operative to selectively and automatically move said seal between said first and second positions as said container is tipped from the vertical orientation toward a drinking orientation, said actuator maintaining the seal in the closed position while the container is tipped in other then the drinking orientation.

6. The lid of claim 5 further comprising a stop limiting the movement of said seal.

7. The lid of claim 5 further comprising locking means operative to lock said seal in one of said positions.

8. The lid of claim 5 further comprising a rod extending between said actuator and said seal.

9. The lid of claim 8 further comprising locking means operative to lock said seal in one of said positions.

10. The lid of claim 9 wherein said locking means selectively engages said rod to prevent its movement.

11. The lid of claim 10 wherein said locking means includes a handle extending through said lid.

12. The lid of claim 10 wherein said locking means includes a slide arranged to move laterally along said lid.

13. The lid of claim 10 wherein said locking means includes a knob arranged to move in a direction normal to said body to selectively engage said rod.

14. The lid of claim 5 wherein said seal and said actuator are formed integrally as a single piece.

15. A container-and-lid assembly comprising:

a container for containing a liquid and having a vertical axis and a mouth;

a lid with a spout covered by a seal, said seal being supported by said lid and being movable between an open and closed position to open and close said spout; and a weight rotatably mounted on a weight shaft supported by said lid, said weight shaft being disposed horizontally when said container is vertical, said weight being coupled to said seal for selectively controlling the movement of said seal automatically as said container is tipped from its vertical position toward a dispensing position to move said seal to the open position in which the liquid can be dispensed through said spout, and to return said seal to the closed position as the container is returned to the vertical position, said weight being rotated by gravity, said weight maintaining said seal in the closed position when the container is tipped in directions other then said dispensing position.

16. The assembly of claim 15 wherein said weight is rotated from a first to a second weight position by gravity as said container is tipped to said dispensing position, and then is pivoted back by gravity when the container is returned to its vertical position.

17. The assembly of claim 16 further comprising a coupling connecting said weight to said seal, wherein said coupling causes said seal to move generally linearly when said weight is pivoted.

18. The assembly of claim 17 wherein said coupling is a rod having one end attached to said weight and another end attached to said seal.

19. A container lid for closing the mouth of a container holding a liquid, said container lid comprising:

a lid body having a perimeter shaped to fit over the mouth;

a spout formed in said body adjacent to said perimeter and shaped to provide a dispensing opening for the liquid;

a seal attached to said lid and moving between an open configuration in which the spout is opened and a closed configuration in which the spout is closed to prevent liquid from splashing out of the container;

a coupling; and a weight pivotably attached to the lid and connected by the coupling to said seal, wherein the weight is rotating with respect to a horizontal axis when said container is tipped, said coupling converting the rotation of the weight into a horizontal motion of said seal, said weight further maintaining said seal in the closed configuration when the container is tipped in directions other then said open configuration.

20. The container lid of claim 19 further comprising a shaft attached to said lid body and extending into said container, said weight being mounted on said shaft.

21. The container lid of claim 20 wherein said coupling includes a rod having a first end connected to said weight at a point spaced from said shaft and a second end connected to said seal.

22. The container of claim 1 wherein said seal remains open after the container is tilted by more then 90 degrees.

* * * * *